US012747512B2

(12) United States Patent
Tyagi et al.

(10) Patent No.: US 12,747,512 B2
(45) Date of Patent: Sep. 29, 2026

(54) ELECTROLYZER WITH HORIZONTAL CATHODE

(71) Applicant: VERDEEN CHEMICALS INC., Bellevue, WA (US)

(72) Inventors: Vipin Tyagi, Bellevue, WA (US); Amol Harishchandra Naik, Mumbai (IN); Bhaskar Gopal Krishna, Ghaziabad (IN); Dhurvender Kumar, Ghaziabad (IN); Nishchay Chadha, Singapore (SG)

(73) Assignee: VERDEEN CHEMICALS INC., Bellevue, WA (US)

( * ) Notice: Subject to any disclaimer, the term of this patent is extended or adjusted under 35 U.S.C. 154(b) by 686 days.

(21) Appl. No.: 17/567,046

(22) Filed: Dec. 31, 2021

(65) Prior Publication Data

US 2023/0212771 A1 Jul. 6, 2023

(51) Int. Cl.

| | |
|---|---|
| ***C25C 7/06*** | (2006.01) |
| ***C25C 1/18*** | (2006.01) |
| ***C25C 7/02*** | (2006.01) |

(52) U.S. Cl.

CPC ..... *C25C 7/06* (2013.01); *C25C 1/18* (2013.01); *C25C 7/02* (2013.01)

(58) Field of Classification Search

CPC .... C25C 1/18; C25C 7/00; C25C 7/02; C25C 7/06

See application file for complete search history.

(56) References Cited

U.S. PATENT DOCUMENTS

| | | | | |
|---|---|---|---|---|
| 1,911,604 | A | 5/1933 | Callbeck | |
| 3,554,893 | A * | 1/1971 | Varda | C25C 3/08 204/244 |
| 3,562,135 | A * | 2/1971 | Marincek | C25C 3/06 204/290.13 |
| 4,414,089 | A * | 11/1983 | McMonigle | C25C 7/005 204/244 |
| 4,416,746 | A * | 11/1983 | Kerby | C25C 1/18 205/342 |
| 9,837,689 | B2 | 12/2017 | Clarke et al. | |
| 10,316,420 | B2 | 6/2019 | Clarke et al. | |
| 10,689,769 | B2 | 6/2020 | Clarke et al. | |
| 10,793,957 | B2 | 10/2020 | Clarke et al. | |
| 11,028,460 | B2 | 6/2021 | Clarke et al. | |
| 2006/0169590 | A1 * | 8/2006 | Hebditch | C25C 3/34 205/46 |
| 2016/0068928 | A1 * | 3/2016 | Jalbout | C22B 15/0065 75/10.62 |

* cited by examiner

*Primary Examiner* — Ciel P Contreras

(57) ABSTRACT

Disclosed herein is an electrolyzer comprising a horizontal cathode located below a suspended anode for purposes of performing electrolysis on metal-bearing mixtures or solutions. The horizontal cathode may comprise the bottom surface of a compartment for containing a mixture or solution of metal components, electrolyte, and/or supplemental chemicals. The horizontal anode may engage the upper surface of the mixture or solution in the compartment. A removal mechanism for facilitating removal of the end-products of the mixture or solution from the compartment (and the surface of the horizontal cathode) through the gate may also be employed. These implementations may be used in recycling of lead acid batteries (LABs) without any need for smelting, and also may be applied to a variety of different electrolytical operations.

20 Claims, 10 Drawing Sheets

FIG. 2A
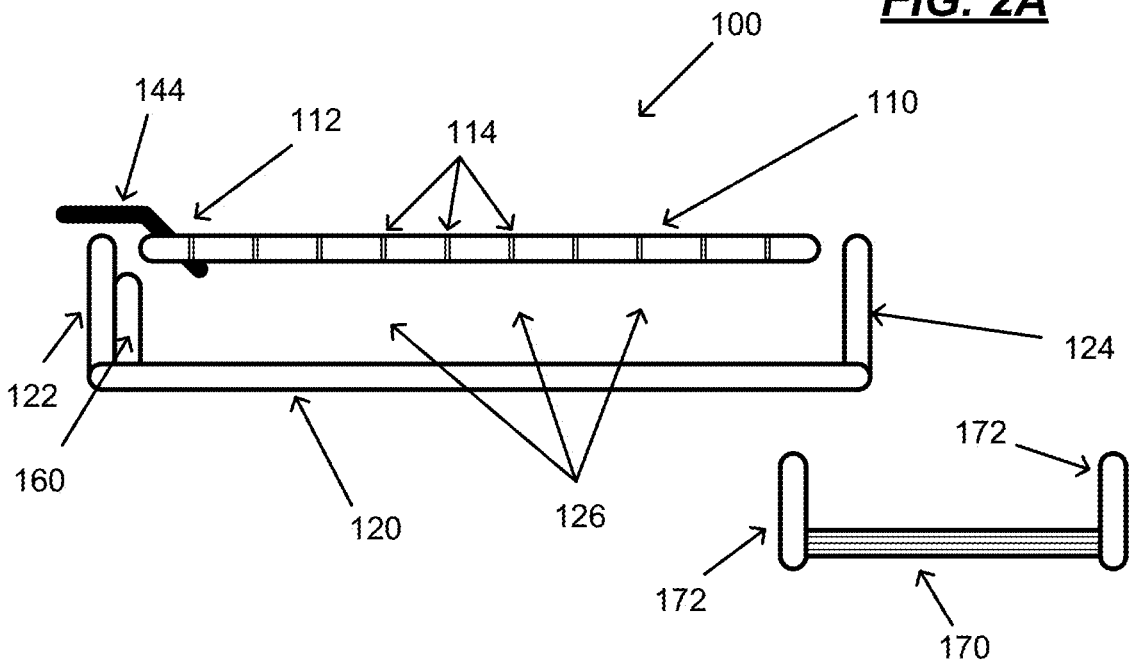
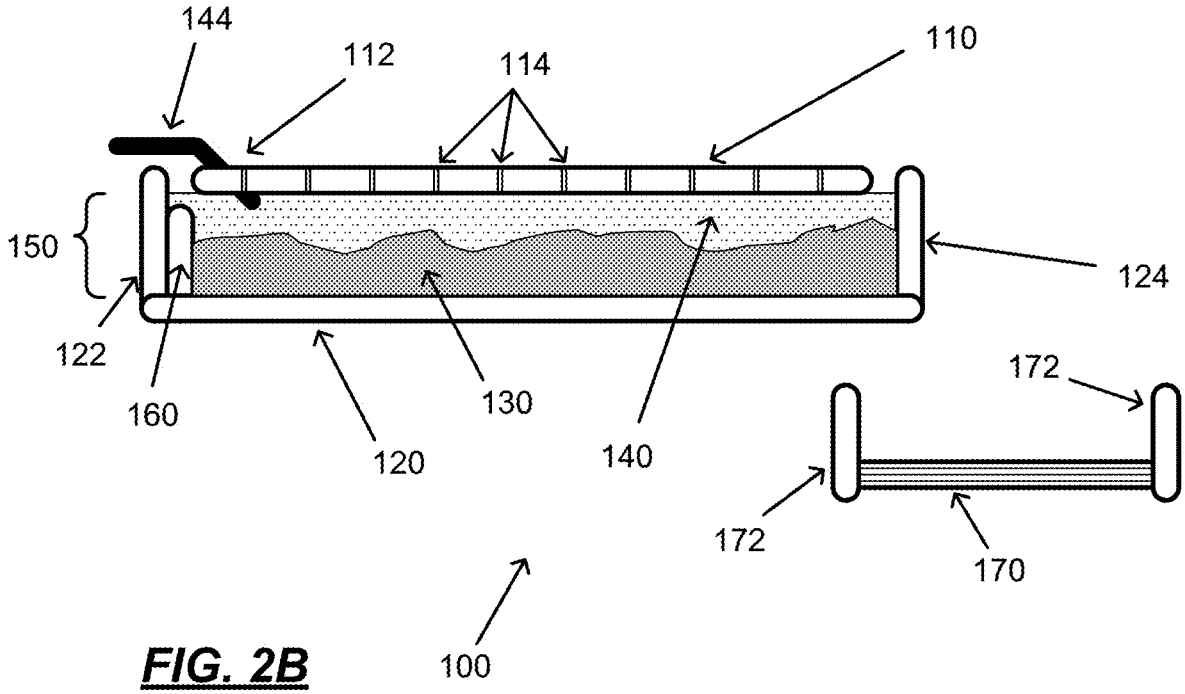
FIG. 2B

FIG. 2C
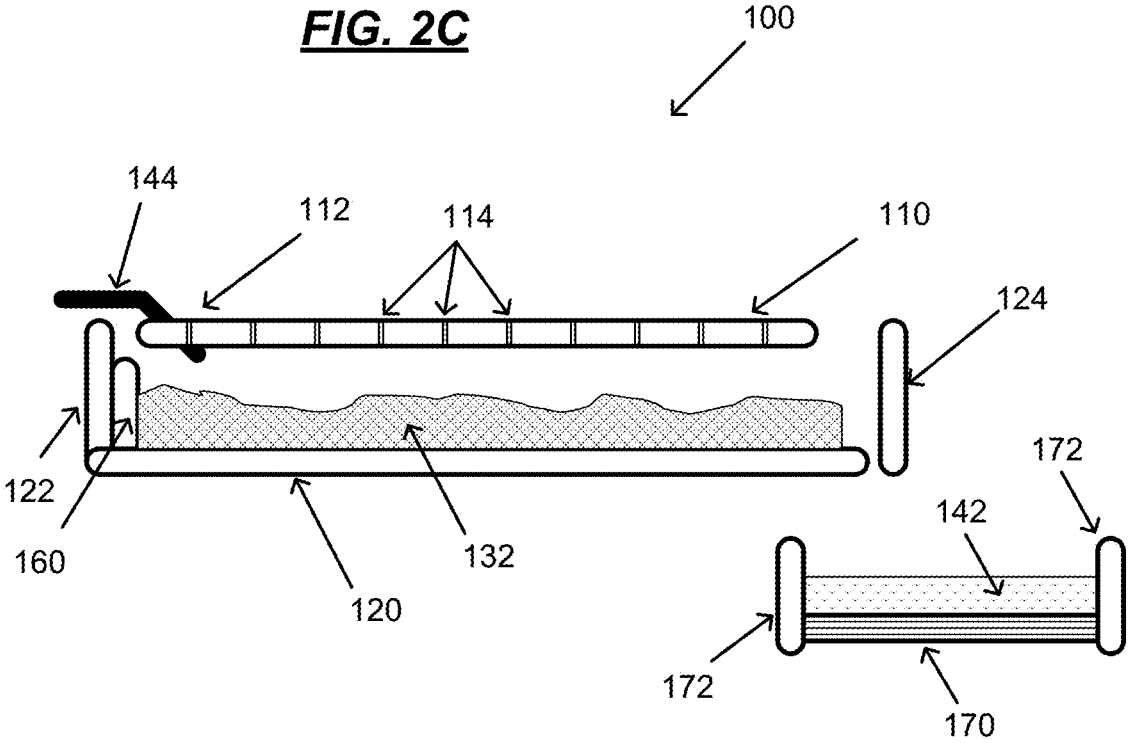
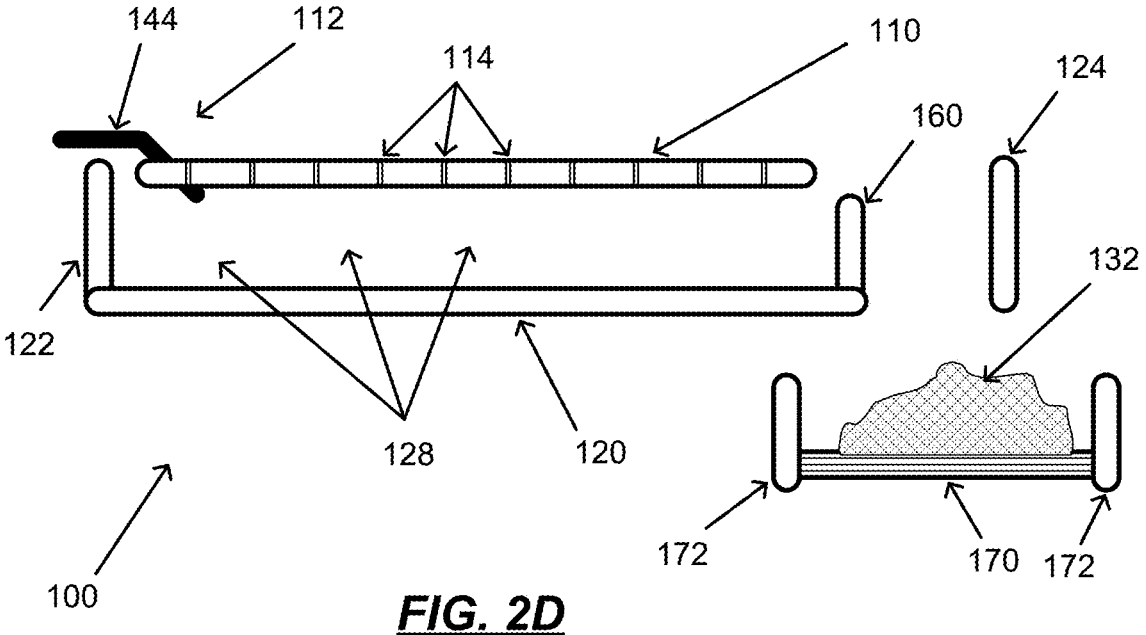
FIG. 2D

FIG. 3A
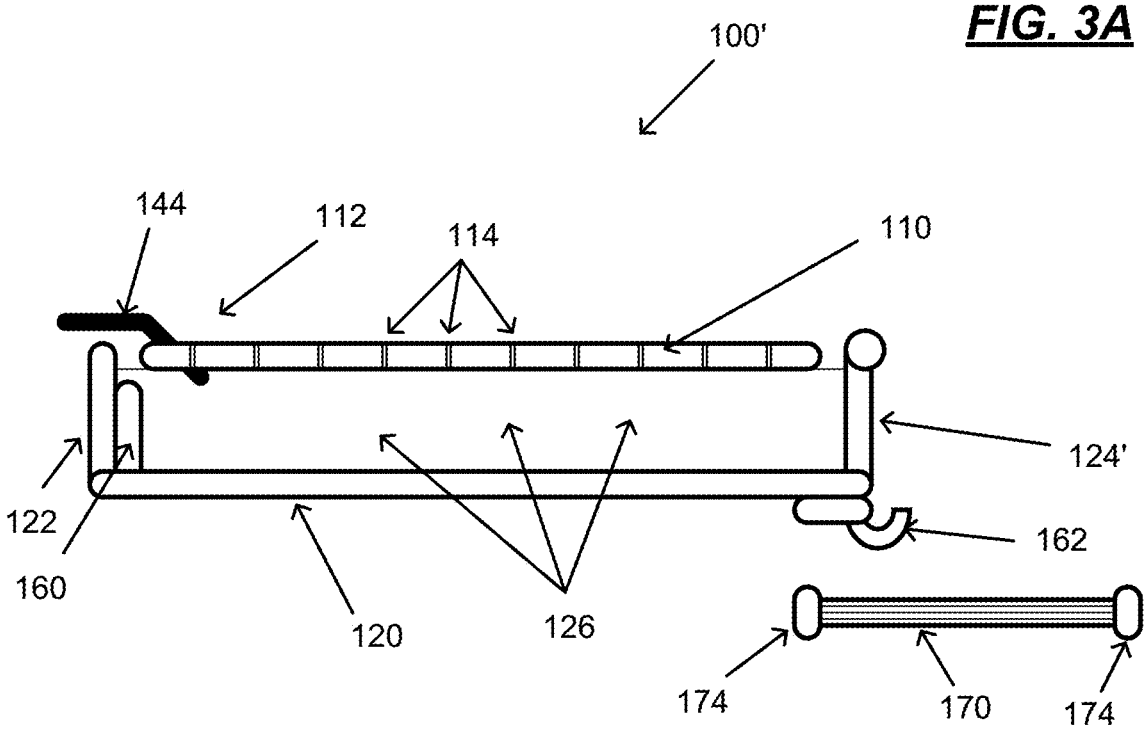
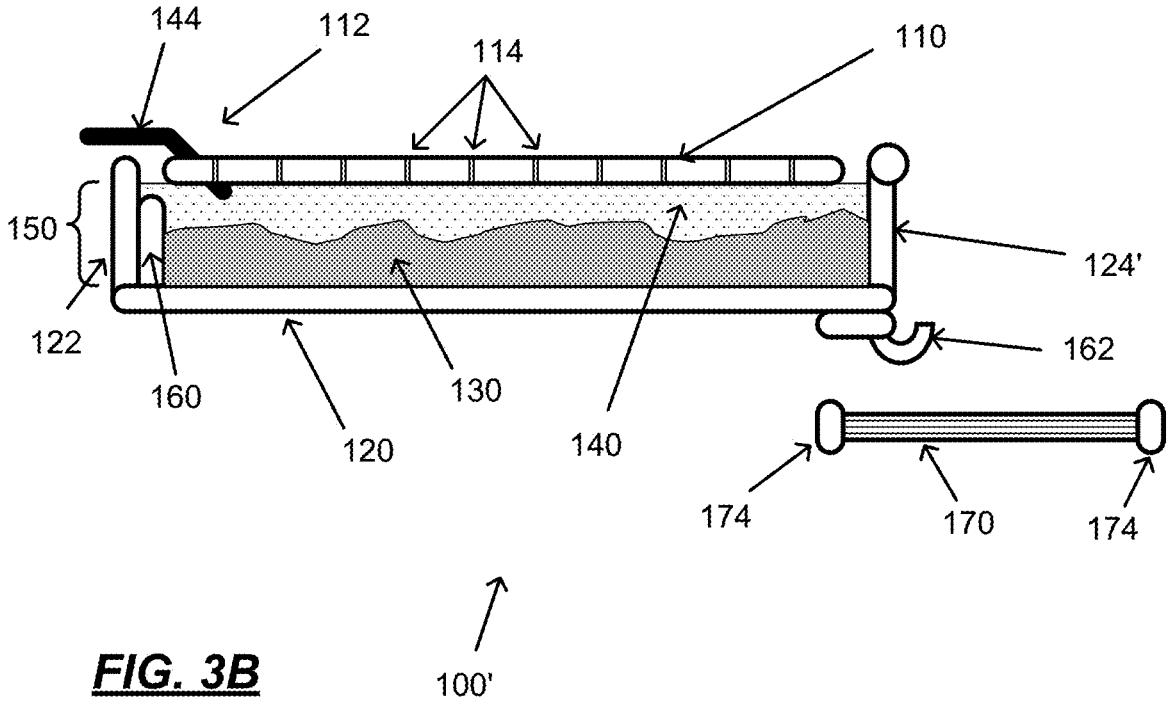
FIG. 3B

FIG. 3C
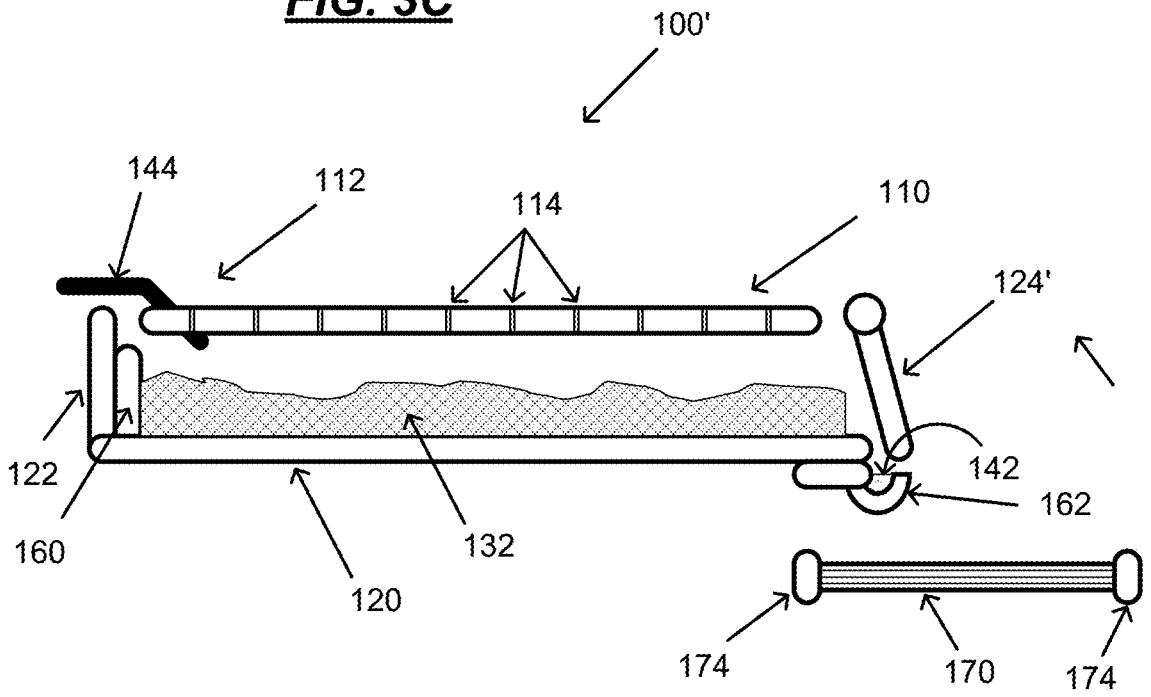
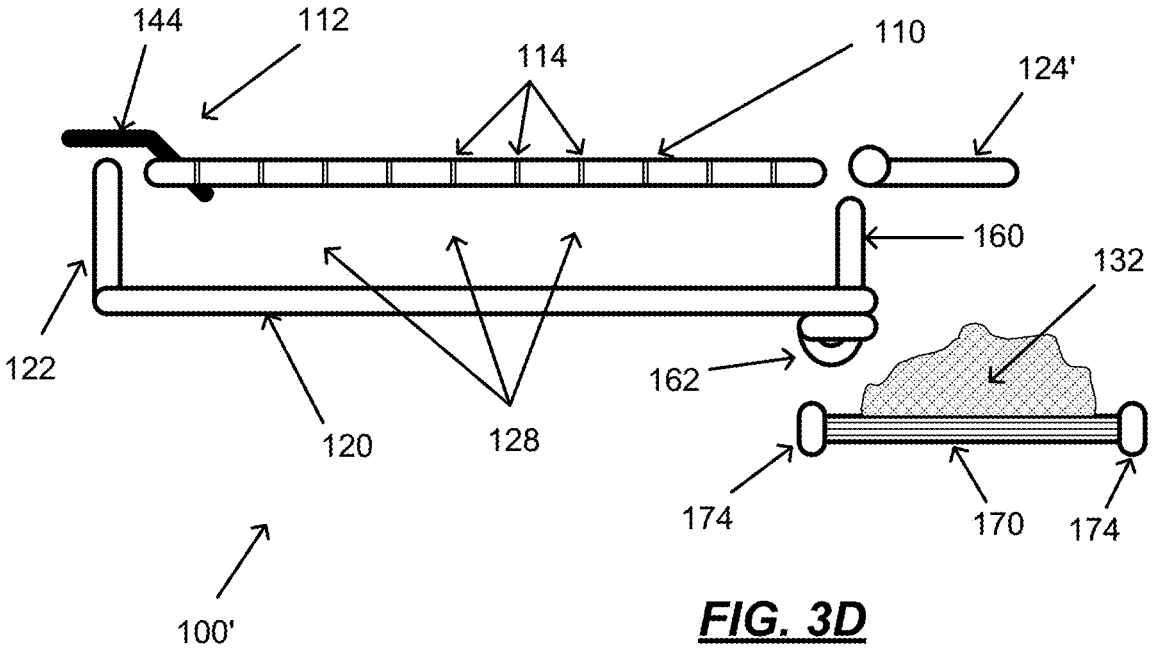
FIG. 3D

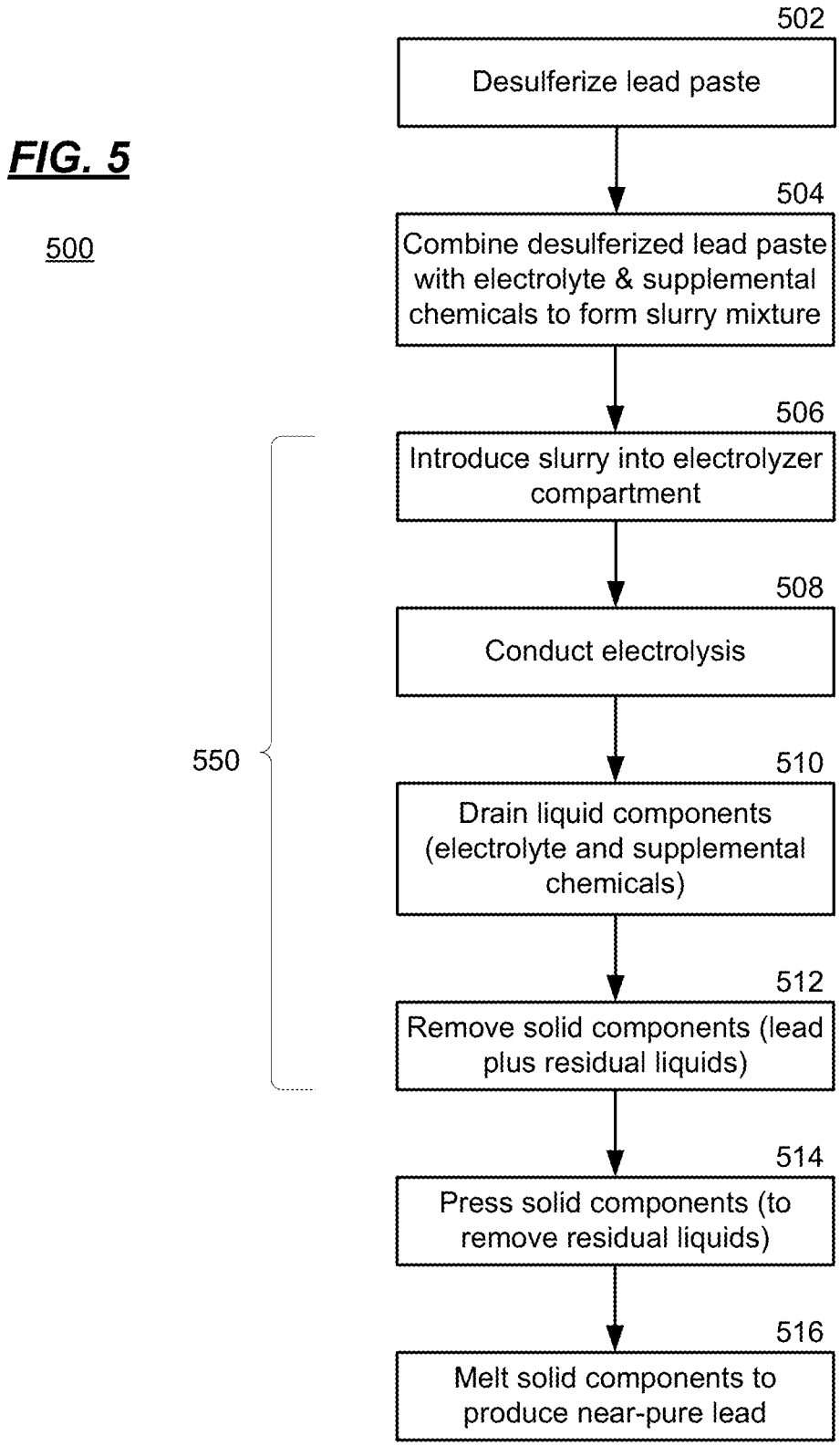
FIG. 5
500
502
Desulferize lead paste
504
Combine desulferized lead paste with electrolyte & supplemental chemicals to form slurry mixture
506
Introduce slurry into electrolyzer compartment
508
Conduct electrolysis
550
510
Drain liquid components (electrolyte and supplemental chemicals)
512
Remove solid components (lead plus residual liquids)
514
Press solid components (to remove residual liquids)
516
Melt solid components to produce near-pure lead

ELECTROLYZER WITH HORIZONTAL CATHODE

BACKGROUND

Lead acid batteries (LABs) are widely used today and, unlike other battery types, are almost entirely recyclable, making them the single most recycled commodity today. Recycling lead is economically important because LAB production continues to increase globally year over year yet production of new lead is becoming increasingly difficult due to depletion of lead-rich ore deposits. However, almost all current lead recycling from LABs at industrial scale is based on smelting, a pyro-metallurgical process in which lead, lead oxides, and other lead compounds are heated to approximately 1600 degrees F. to 2200 degrees F. (900 degrees C. to 1200 degrees C.) and then mixed with various reducing agents to remove oxygen, sulfates, and other non-lead materials.

Unfortunately lead smelting is highly polluting due to its generation of significant airborne waste (e.g., lead dust, arsenic, carbon dioxide, and sulfur dioxide), solid waste (e.g., slag that contains hazardous compounds of lead and other heavy metals), and liquid waste (e.g., sulfuric acid, arsenic, and other heavy metals and their oxides). Indeed, the pollution generated from smelting is so high that it has forced the closure of many smelters in the U.S. and other western nations to protect the environment. And although migration and expansion of smelting in less regulated countries has resulted in large scale pollution and high levels of human lead contamination in those countries, similar curtailing measures are expected in those countries is expected as time progresses and new technologies become available.

SUMMARY

Various implementations disclosed herein are directed to an electrolyzer comprising a horizontal cathode located below a suspended anode for purposes of performing electrolysis on metal-bearing mixtures or solutions. For several such implementations, the horizontal cathode may comprise the bottom surface of a compartment for containing a mixture or solution of metal components, electrolyte, and/or supplemental chemicals; a horizontal anode for engaging the upper surface of the mixture or solution in the compartment; a gate corresponding to one sidewall of the compartment for facilitating removal of the end-products from the mixture or solution; and/or a removal mechanism for facilitating removal of the end-products of the mixture or solution from the compartment (and the surface of the horizontal cathode) through the gate. Certain implementations disclosed herein are specifically directed to use in recycling of lead acid batteries (LABs) without smelting, although nothing herein is intended to limit the various implementations solely to LAB recycling or lead recovery and, instead, the various implementations disclosed herein may be applied to a variety of different electrolysis operations.

More specifically, disclosed herein are various implementations directed to systems, processes, apparatuses, methods, computer-readable instructions, and other implementations for an electrolyzer comprising: a horizontal cathode having a surface onto which an electrolytic slurry may be emplaced for electrolysis; and an anode suspended above the horizontal cathode for physically engaging the electrolytic slurry for electrolysis. Several such implementations may further comprise vertical containing surfaces for containing the electrolytic slurry onto the horizontal cathode; a gate in the vertical containing surfaces through which an end product resulting from electrolysis can be removed from the cathode; a removing mechanism for removing, from the horizontal cathode, an end product resulting from electrolysis; a direct current electrical supply and a power controller for controlling a current during electrolysis at one or more levels at one or more time periods during electrolysis; and/or a slurry line for emplacing the electrolytic slurry onto the horizontal cathode. For certain such implementations the suspended anode may comprise a horizontal anode surface for physically engaging an upper surface of the electrolytic slurry for electrolysis; the horizontal anode surface may comprise a plurality of vents, trenches, or holes through which gaseous compounds ("gasses") resulting from electrolysis can be passed, and/or the horizontal anode surface may be substantially parallel to the horizontal cathode and between 40 mm and 140 mm above the horizontal cathode during electrolysis.

Several alternative implementations disclosed herein may be directed to an apparatus for performing electrolysis comprising: a horizontal cathode having a surface onto which an electrolytic slurry may be emplaced for electrolysis; and an anode suspended above the horizontal cathode, the anode comprising a horizontal surface for physically engaging an upper surface of the electrolytic slurry for electrolysis. Several such implementations may further comprise vertical containing surfaces for containing the electrolytic slurry onto the horizontal cathode; a gate in the vertical containing surfaces through which an end product resulting from electrolysis can be removed from the cathode; a removing mechanism for removing, from the horizontal cathode, an end product resulting from electrolysis; a direct current electrical supply and a power controller for controlling a current during electrolysis at one or more levels at one or more time periods during electrolysis; and/or a slurry line for emplacing the electrolytic slurry onto the horizontal cathode. For certain such implementations the horizontal anode surface comprises a plurality of vents, trenches, or holes through which gaseous compounds resulting from electrolysis can be passed; and/or the horizontal anode surface is substantially parallel to the horizontal cathode and between 40 mm and 140 mm above the horizontal cathode during electrolysis.

Other alternative implementations disclosed herein may be directed to a system for performing electrolysis on an electrolytic slurry comprising: a horizontal cathode having a surface onto which the electrolytic slurry may be emplaced for electrolysis; an anode suspended above the horizontal cathode for physically engaging the electrolytic slurry for electrolysis; and a removing mechanism for removing, from the horizontal cathode, an end product resulting from electrolysis. For certain such implementations the suspended anode comprises a horizontal anode surface for physically engaging an upper surface of the electrolytic slurry for electrolysis; and/or the horizontal anode surface comprises a plurality of vents, trenches, or holes through which gaseous compounds resulting from electrolysis can be passed.

This summary is provided to introduce a selection of concepts in a simplified form that are further described below in the detailed description. This summary is not intended to identify key features or essential features of the claimed subject matter, nor is it intended to be used to limit the scope of the claimed subject matter, nor is it an admission that any of the information provided herein is prior art to the implementations described herein.

BRIEF DESCRIPTION OF THE DRAWINGS

The foregoing summary and the following detailed description of illustrative implementations are better understood when read in conjunction with the appended drawings. For the purpose of illustrating the implementations, there is shown in the drawings example constructions of the implementations; however, the implementations are not limited to the specific methods and instrumentalities disclosed. In the drawings:

FIG. 2A is an illustration providing a cut-away side view of the electrolyzer cell of FIG. 1A and FIG. 1B, representative of the various implementations disclosed herein, in an initial ready-to-use configuration for conducting electrolysis;

FIG. 2B is an illustration providing a cut-away side view of the electrolyzer cell of FIG. 1A and FIG. 1B, representative of the various implementations disclosed herein, after being filled with electrolytic materials for electrolysis;

FIG. 2C is an illustration providing a cut-away side view of the electrolyzer cell of FIG. 1A and FIG. 1B, representative of the various implementations disclosed herein, after electrolysis has been performed and liquid components have been drained from the electrolyzing compartment;

FIG. 2D is an illustration providing a cut-away side view of the electrolyzer cell of FIG. 1A and FIG. 1B, representative of the various implementations disclosed herein, after the end product of the electrolysis has been scraped from the horizontal cathode surface and removed from the electrolyzing compartment;

FIG. 3A is an illustration providing a cut-away side view of an alternative electrolyzer cell similar to that shown in FIG. 1A, representative of the various alternative implementations disclosed herein, in an initial ready-to-use configuration for conducting electrolysis;

FIG. 3B is an illustration providing a cut-away side view of an alternative electrolyzer cell similar to that shown in FIG. 1A, representative of the various alternative implementations disclosed herein, after being filled with electrolytic materials for electrolysis;

FIG. 3C is an illustration providing a cut-away side view of an alternative electrolyzer cell similar to that shown in FIG. 1A, representative of the various alternative implementations disclosed herein, after electrolysis has been performed and liquid components have been drained from the electrolyzing compartment;

FIG. 3D is an illustration providing a cut-away side view of an alternative electrolyzer cell similar to that shown in FIG. 1A, representative of the various alternative implementations disclosed herein, after the end product of the electrolysis has been scraped from the horizontal cathode surface and removed from the electrolyzing compartment;

FIG. 5 is a process flow diagram illustrating how the various implementations disclosed herein may be utilized for lead acid battery (LAB) recycling.

DETAILED DESCRIPTION

Figure 1A:
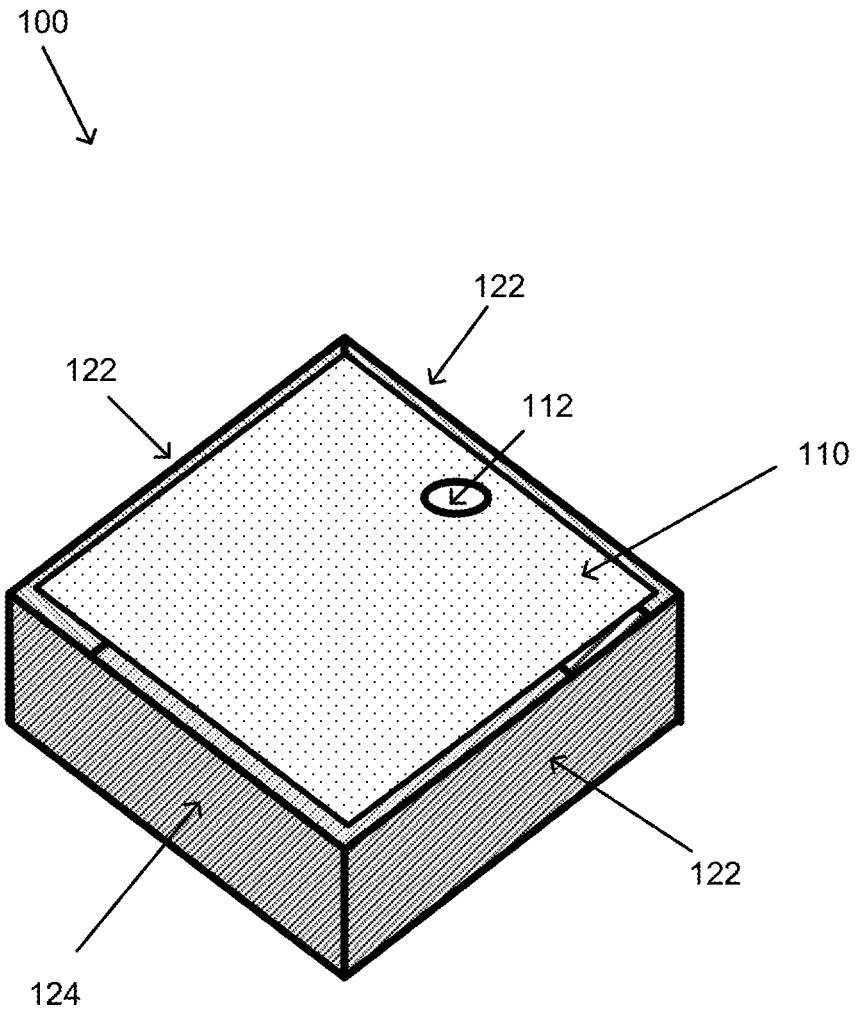
FIG. 1A is an illustration providing a perspective view of an electrolyzer cell 100 representative of various implementations disclosed herein.

Disclosed herein are various implementations directed to an electrolyzer comprising a horizontal cathode located below a suspended anode for purposes of performing electrolysis on metal-bearing mixtures or solutions. For several such implementations, the horizontal cathode may comprise the bottom surface of a compartment for containing a mixture or solution of metal components, electrolyte, and/or supplemental chemicals; a horizontal anode for engaging the upper surface of the mixture or solution in the compartment; a gate corresponding to one sidewall of the compartment for facilitating removal of the end-products from the mixture or solution; and/or a removal mechanism for facilitating removal of the end-products of the mixture or solution from the compartment (and the surface of the horizontal cathode) through the gate. Certain implementations disclosed herein are specifically directed to use in recycling of lead acid batteries (LABs) without smelting, although nothing herein is intended to limit the various implementations solely to LAB recycling or lead recovery and, instead, the various implementations disclosed herein may be applied to a variety of different electrolysis operations.

An understanding of various concepts is helpful toward a broader and more complete understanding of the various implementations disclosed herein, and skilled artisans will readily appreciate the implications these various concepts have on the breadth and depth of the various implementations herein disclosed. Certain terms used herein may also be used interchangeably with other terms used herein and such terms should be given the broadest interpretation possible unless explicitly noted otherwise. For example, as used herein the terms electrolysis, electrowinning, and electrorefining should be treated as interchangeable terms such that where one term is used the other terms are also implied, and thus any use of the term electrolysis should be understood to also include electrowinning and electrorefining except where explicitly differentiated. On the other hand, the term "electrolytic processes" is explicitly intended to include and encompass electrolysis, electrowinning, and electrorefining. Furthermore, as will be readily appreciated and well-understood by skilled artisans, substances that might typically be represented by their chemical compositions using subscripted numbers—such as gaseous oxygen ($O_2$), water ($H_2O$), and so forth—may instead be represented herein without subscripted numbers, i.e., as $O_2$ for gaseous oxygen, $H_2O$ for water, and so forth.

Electrolytic Processes

As well-known and readily-appreciated by skilled artisans, electrolysis is a technique that uses an electrical direct current (DC) to drive an otherwise non-spontaneous chemical reaction. Using an electrolytic cell, electrolysis can be used to separate elements from one another. More specifically, in an electrolysis process an electrical current—specifically, a direct current (DC)—is passed through an electrolyte to produce chemical reactions at the electrodes and decomposition of the materials in the electrolyte.

The main components required to achieve electrolysis are an electrolyte, electrodes, and an external power source. The electrolyte is a chemical substance which contains free and mobile ions and is capable of conducting an electric current. An electrolyte may be an ion-conducting polymer, a solution, or an ionic liquid compound. For example, a liquid electrolyte may be produced by "salvation," that is, by the attraction or association of ions of solute with a solvent (such as water) to produce mobile cluster of ion and solvent molecules.

To achieve electrolysis, the electrodes (which are properly connected to a power source) are immersed in an electrolyte but separated from each other by a sufficient distance such that a current flows between them through the electrolyte with the electrolyte completing the electrical circuit. In this configuration, the electrical direct current supplied by the power source attracts ions toward the respective oppositely charged electrodes and drives the non-spontaneous reaction.

Each electrode attracts ions that are of the opposite charge: positively charged ions ("cations") move towards the electron-providing negatively-charged cathode, and negatively charged ions ("anions") move towards the electron-extracting positively-charged anode. In effect, electrons are introduced at the cathode (as a reactant) and removed at the anode (as the desired end product). The loss of electrons is referred to as oxidation, and the gain of electrons is referred to as reduction.

Cathodes may be made of the same material as anodes but, typically, are instead made from a more reactive material since anode wear is greater due to oxidation at the anode. Anodes may be made of the same material as cathodes; however, oftentimes anodes are instead made from a less reactive material than the cathode because during electrolysis the wear on the anode is generally greater than the wear on the cathode due to oxidation that occurs at the anode.

When neutral atoms or molecules gain or lose electrons—such as those that might be on the surface of an electrode—they become ions and may dissolve in the electrolyte and react with other ions. Conversely, when ions gain or lose electrons and become neutral, they may form compounds that separate from the electrolyte. For example, positive metal ions may deposit onto the cathode in a layer. Additionally, when ions gain or lose electrons without becoming neutral, their electronic charge is nonetheless altered in the process.

The key process of electrolysis is the interchange of atoms and ions via the addition or removal of electrons resulting from the applied electrical direct current to produce the desired end product (or multiple end products as the case may be). The desired end product of electrolysis is often in a different physical state from the electrolyte and may be removed by one of several different physical processes such as, for example, by collecting a gaseous end product from above an electrode, by electrodeposition of the dissolved end product out of the electrolyte, or by removing solid end product buildup at one of the electrodes (e.g., scraping).

Whereas the decomposition potential of an electrolyte is the voltage needed for electrolysis to occur, the quantity of the end product derived from electrolysis is proportional to the electric current applied and, under Faraday's laws of electrolysis, when two or more electrolytic cells are connected in series to the same power source, the end product produced in the cells are proportional to their equivalent weight.

Solid-State Electrolysis

For "solid-state electrolysis," a solid metallic compound or a mixture of metallic compounds ("active material") may be reduced into a pure metal end product via electrolysis by placing the active material in direct contact with the cathode of the electrolytic cell. However, because various active materials are not naturally adhesive, placing active material onto a cathode surface (e.g., "pasting") can be problematic.

Typically active material is pasted directly onto the cathode by removing the cathode from the electrolyte in the electrolytic cell and applying a mixture of active material and electrolyte onto the cathode surface. After this mixture is allowed to dry on the cathode, the cathode is then again suspended in the electrolyte of the electrolytic cell. However, at an industrial scale of operations, pasting of active material onto cathode surface is time-consuming and expensive due in part to the size of electrodes required for such pasting. Moreover, during electrolysis the dry-pasted active material on the cathode may absorb moisture from the electrolyte in the electrolytic cell, causing the pasted material to slough off or slide away from the cathode, and which also results in water-type electrolysis of this absorbed moisture, that together effectively substitutes for and/or precludes the desired electrolytic reaction of the active material. Additionally, it may be natural for what little end product that results to buildup at and adhere to the cathode itself, and removing this end product from the cathode may be time-consuming, inefficient, and expensive.

It is because of these inherent shortcomings that solid state electrolysis has not been utilized for processing active materials commercially on an industrial scale, such industries opting instead for more traditional approaches for purifying active material into the desired end products such as, for example, smelting. However, as well-known and widely understood by skilled artisans, smelting has its own shortcomings and thus there remains a need for an alternative purifying process and machinery for performing same on an industrial scale.

Lead Acid Battery Recycling

As briefly described earlier herein, lead acid batteries (LABs) are widely used today and, unlike other battery types, are almost entirely recyclable, making lead acid batteries the single most recycled item today. Recycling lead is economically important because LAB production continues to increase globally year over year, yet production of new lead is becoming increasingly difficult due to depletion of lead-rich ore deposits. However, almost all current lead recycling from LABs at industrial scale is based on smelting, a pyro-metallurgical process in which lead, lead oxides, and other lead compounds are heated to approximately 1600 degrees F. to 2200 degrees F. (900 degrees C. to 1200 degrees C.) and then mixed with various reducing agents to remove oxygen, sulfates, and other non-lead materials.

Unfortunately lead smelting is highly polluting due to its generation of significant airborne waste (e.g., lead dust, arsenic, carbon dioxide, and sulfur dioxide), solid waste (e.g., slag that contains hazardous compounds of lead and other heavy metals), and liquid waste (e.g., sulfuric acid, arsenic, and other heavy metals and their oxides). Indeed, the pollution generated from smelting is so high that it has forced the closure of many smelters in the U.S. and other western nations to protect the environment. And although migration and expansion of smelting in less regulated countries has resulted in large scale pollution and high levels of human lead contamination in those countries, similar curtailing measures are expected in those countries is expected as time progresses and new technologies become available.

Although numerous approaches for lead recycling from LABs are known in the art, they all suffer from one or more disadvantages that render them impractical. As such, there remains a need for improved devices and methods for scalable smelterless recycling of LABs that can achieve maximum lead recovery with minimal environmental impact or undue cost. And although some efforts have been made to move away from smelting operations and to use more environmentally friendly solutions, to date all have come up short for various reasons ranging from different pollution problems to low-yields and low-profitability to lab-type solutions that cannot be scaled up effectively or efficiently.

Electrolytic Processes

Like copper, gold, silver, zinc, and many other metals, lead (Pb) can be recovered from various lead-containing materials—and, in particular, from lead paste recovered from lead acid batteries (LABs)—by electrolytic processes (e.g., electrolysis). Typically, lead paste may be dissolved in an electrolyte and the resulting solution then subjected to electrolytic recovery of the elemental lead at the cathode.

However, while conceptually simple and easily implemented on a small scale, in reality the economic recovery of lead from battery paste in an environmentally benign manner via electrolysis has remained elusive for recovery at sufficient levels of yield and purity. Moreover, the electrode materials for lead recovery are often expensive, and operating conditions at the electrodes tend to promote formation of undesirable side products. For example, in existing electrolytic approaches, lead dioxide frequently forms at the anode due to its capability to further oxidize, and such oxidation can become problematic as large quantities of insoluble lead dioxide limit the current and diminish operational effectiveness. Similarly, lead produced at the cathode from an acidic electrolyte will deposit on the cathode as a film that can be difficult to remove from the cathode or that may be re-dissolved into the electrolyte if/when the electric current (i.e., the electricity supply for performing the electrolysis) is discontinued.

Electrolyzer Cell with Horizontal Cathode

Various implementations disclosed herein are directed to an electrolyzer cell comprising a horizontal cathode over which a horizontal anode is suspended. For several such implementations the horizontal cathode may form the base of an electrolyzer compartment into which a mixture of active material and electrolyte—in the form of a slurry, for example—may be introduced, held, and processed. For such implementations, the horizontal anode may be suspended above the cathode in the upper portion of the electrolyzer compartment in such a manner that the anode would physically engage the upper surface of the mixture of active material and electrolyte being held by the electrolyzer compartment while the cathode would naturally engage the bottom surface of the mixture of active material being held in the electrolyzer compartment. The anode may also comprise small openings in the form of vents, trenches, holes, or the like (which may be referred to herein simply as "breathing holes") across the surface of the anode in order to allow gaseous oxygen (O2) and/or other gaseous substances resulting from the electrolysis to harmlessly escape (instead of being trapped under said anode and creating current resistance).

For these various implementations—and in combination with use of additional supplemental chemicals added to the slurry mixture of active material and electrolyte (discussed further below)—an electrical DC current may then be passed from the cathode to the anode through the mixture of active material and electrolyte to produce the desired end product and cause that desired end product to settle on the surface of the cathode. (For certain such implementations, the end product may be pure lead in a spongy form that retains some of the electrolyte and/or supplemental chemicals.) More specifically, the electrical DC current would effectively cause the reduction of metal ions in the active material to disassociate from their counter ion—such as oxide and hydrogen ions which in turn may form water (H2O) and gaseous oxygen (O2)—and the metal, now in its pure form, would then be drawn to and settle upon the horizontal cathode surface due in part to gravity (the metal being heavier than other components in the slurry) and aided in part by the natural ionic convection that occurs in the mixture during electrolysis.

Once the electrolysis is complete, and for several such implementations herein disclosed, the electrolyzer compartment may further comprise an openable side for removing the electrolyte (including the supplemental chemicals and the additional H2O produced during the electrolysis) as well as the end-product metal. Initially this openable side may be only partially opened in order to first permit the purely liquid components—i.e., much of the remaining electrolyte, supplemental chemicals, and the additional water (H2O) produced during the electrolysis—to exit the electrolyzer compartment and, for certain implementations, be channeled away via a small channeling gutter at the base of the openable side. In some implementations, this channeling gutter may then be moved to a storage position away from the openable side (e.g., to below the electrolyzer compartment) after the liquid components have been drained through the openable side of the electrolyzer compartment.

After the liquid components have been drained away—or, in alternative implementations, without first draining the liquid components separately—the openable side may be fully opened to permit the more solid components—namely the end-product metal plus any residual liquid components adhering thereto—to be physically removed from the electrolyzer compartment. For select implementations, the removal may be performed by a vertically-oriented scraping mechanism extending across the width of the electrolyzer compartment and originating on the side opposite the openable side, said scraping component physically contacting and gently scraping the entire cathode surface and adjoining sides of the electrolyzer compartment but operating just below (and without physically contacting) the anode surface. In this manner, the scraping mechanism may operate to push the more solid components out of the electrolyzer compartment and into a collecting receptacle or onto a conveying mechanism (e.g., a conveyor belt) for further processing.

In this manner, the various implementations disclosed herein may overcome the shortcomings in existing approaches to solid state electrolysis described above as follows: (1) there would be no need to dry-paste the active material to the cathode, saving time and effort; (2) the build-up of absorbed water by the dry-pasted active material during electrolysis—and the interference with the production of the desired end product that results—could be avoided altogether; and/or (3) the buildup of the end product at the cathode would be easier to remove as the flat surface of the cathode facilitates the scraping action (described above) and the supplemental chemicals may help prevent solidification of the end product or adhesion of the end product to the cathode.

Furthermore, for various implementations disclosed herein, multiple electrolyzer cells of the type described herein can be stacked vertically, with appropriate spacing between each electrolyzer cell, which might share a single vertical drop space for the end product pushed out of the multiple electrolyzer cells in a single collecting receptacle or onto a single conveying mechanism. Additionally, several vertical stacks comprising multiple electrolyzer cells can be arranged in a row and further share a single elongated collecting receptacle or a single elongated conveying mechanism. Moreover, multiple rows of vertical stacks can also be arranged with the produced end product being consolidated for continued processing.

Notably, separate from the disclosures made herein, Applicant has discovered that achieving the electrolytic effects described herein are dependent upon the utilization of certain specific chemicals mixed into the slurry along with the electrolyte and active materials. Although the present application is not directed to the composition of any of the these discovered chemicals, the various implementations disclosed herein are in no way limited to the use of any specific chemical additives regardless of whether secret or proprietary (or widely-used and well-known for that matter).

Figure 1B:
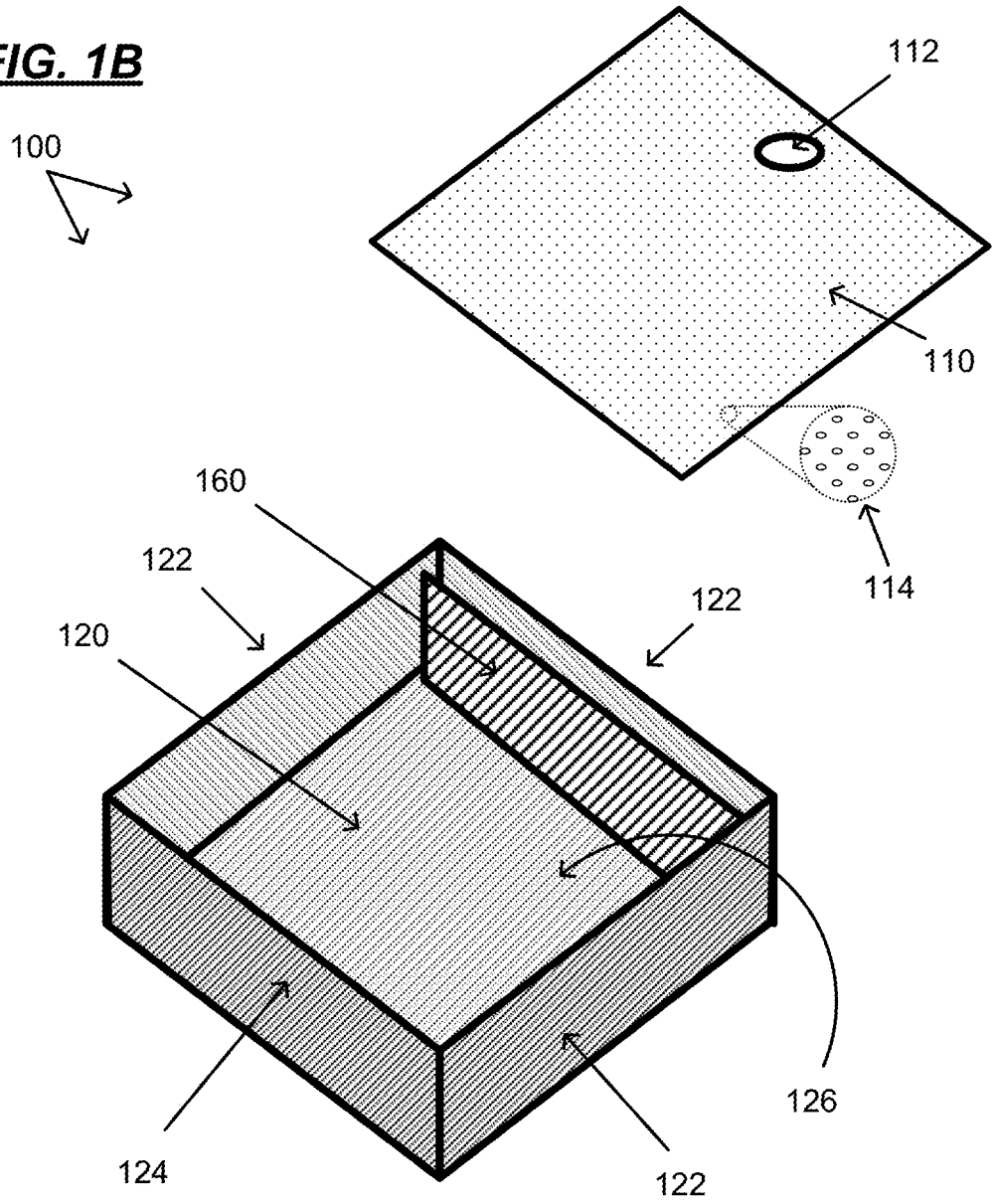
FIG. 1B is an illustration providing a blown-out perspective view of the anode and the interior of the electrolyzer cell of FIG. 1A representative of various implementations disclosed herein.

FIG. 1A is an illustration providing a perspective view of an electrolyzer cell 100 representative of various implementations disclosed herein. FIG. 1B is an illustration providing a blown-out perspective view of the anode 110 and the interior of the electrolyzer cell 100 of FIG. 1A representative of various implementations disclosed herein. For convenience, FIG. 1A and FIG. 1B may be referred to herein collectively as FIG. 1.

As illustrated in FIG. 1, an electrolyzer cell 100 may comprise an anode 110 suspended above a horizontal cathode 120 at a distance suitable for performing electrolysis. The electrolyzer cell 100 may also comprise vertical containing surfaces 122 and at least one gate 124 that, together with the horizontal cathode 120, form and provide an electrolyzer compartment 126 into which a mixture of active material and electrolyte—in the form of a slurry, for example—may be introduced, held, and processed. The vertical containing surfaces 122 and the gate 124—or at least the internal surfaces thereof relative to contents of the electrolyzer compartment 126—may be electrically non-conductive.

As shown, the anode 110 may be configured as a horizontal anode, although other forms of anode may also be utilized such as, for example, a series of anode rods, strips, grids, or other structures that could physically engage the upper surface of an electrolytic slurry emplaced onto the cathode. Regardless, the anode 110 may be suspended above the cathode 120 in the upper portion of the electrolyzer compartment 126 in such a manner that the anode would physically engage the upper surface of the mixture of active material and electrolyte being held by the electrolyzer compartment while the cathode would naturally engage the bottom surface of the active material mixture being held in the electrolyzer compartment. For those implementations featuring a horizontal anode, the anode 110 may also comprise small openings or vents 114 (i.e., "breathing holes") across its surface to allow gaseous oxygen (O2) resulting from electrolysis to harmlessly escape (instead of building up under said anode). The anode 110 may also comprise an opening 112 through which the electrolytic slurry may be emplaced into the electrolyzer compartment and onto the horizontal cathode 120 in sufficient quantity for an upper surface of said electrolytic slurry to simultaneously physically engage the suspended anode 110 and thereby complete the circuit for a current running between the cathode 120 and anode 110 for purposes of electrolysis.

The electrolyzer cell 100 may further comprise a removing mechanism 160. For various implementations, this removing mechanism 160 may comprise a vertically-oriented surface extending across the width of the electrolyzer compartment 126 and originating on the side opposite the gate 124, said surface being capable of physically contacting and gently scraping the entire cathode 120 surface and adjoining sides of the electrolyzer compartment 126 and operating below the anode 110 surface. The removing mechanism—or at least the portions thereof exposed to the contents of the electrolyzer compartment 126—may be electrically non-conductive.

FIG. 2A is an illustration providing a cut-away side view of the electrolyzer cell 100 of FIG. 1A and FIG. 1B, representative of the various implementations disclosed herein, in an initial ready-to-use configuration for conducting electrolysis. As illustrated in FIG. 2A, the electrolyzer compartment 126 is empty but ready to be filled, with the removal mechanism 160 in a set position and with the gate 124 closed. In this configuration, an electrolytic slurry may then be emplaced into the electrolyzer compartment 126 and onto the horizontal cathode 120 via a slurry line 144 extending through the opening 112 in the anode 110. Also shown in FIG. 2A is a conveyor belt 170 comprising containing sides 172 and disposed beneath the gate 124 as a conveying mechanism for use during removal of the contents of the electrolyzer compartment 126 after electrolysis is complete.

FIG. 2B is an illustration providing a cut-away side view of the electrolyzer cell 100 of FIG. 1A and FIG. 1B (as well as FIG. 2A), representative of the various implementations disclosed herein, after being filled with electrolytic materials 150 for electrolysis. As illustrated in FIG. 2B, the electrolytic materials 150 comprise a mixture of active materials 130 and electrolyte 140 as well as supplemental chemicals interspersed therein. The bottom surface of the electrolytic materials 150 physically engages (i.e., is in physical contact with) the horizontal cathode 120 while the upper surface of the electrolytic materials (specifically, the electrolyte component thereof) physically engages the anode 110. (For various implementations, sufficient electrolyte may be included in the electrolytic materials to form the upper surface of the electrolytic materials in order to prevent solid material contact from developing between the cathode and anode which might create an electrical short and prevent the cathode plate from reducing lead ions from the compounds.) An electric current can then be applied to the electrolytic materials 150 via the anode 110 and cathode 120, with the electrical circuit being completed by the mobile ions in electrolyte 140, and with electrolysis taking place in said electrolytic materials 150 accordingly.

FIG. 2C is an illustration providing a cut-away side view of the electrolyzer cell 100 of FIG. 1A and FIG. 1B (as well as FIG. 2A and FIG. 2B), representative of the various implementations disclosed herein, after electrolysis has been performed and liquid components 142 have been drained from the electrolyzing compartment 126 by opening the gate 124 into a first position that provides sufficient space through which said liquid components can pass from the electrolyzer compartment 126 onto the conveyor belt 170 for recovery of said liquid components. Meanwhile the desired end product 132 of the electrolysis remains on the horizontal cathode 120 awaiting its own removal from the electrolyzer compartment 126.

FIG. 2D is an illustration providing a cut-away side view of the electrolyzer cell 100 of FIG. 1A and FIG. 1B (as well as FIG. 2A, FIG. 2B, and FIG. 2C), representative of the various implementations disclosed herein, after the end product 132 resulting from the electrolysis has been removed from the horizontal cathode 120 surface and from the electrolyzing compartment. As shown in FIG. 2D, the gate 124 has moved to a second fully-open position and the removal mechanism 160 has traversed the interior of the electrolyzer cell 100 and removed the end product 132 from the electrolyzer cell 100 and onto the conveyor belt 170. With the removal mechanism 160 in this deployed position and the gate 124 fully open as shown, the empty interior of the electrolyzer cell 128 is no longer an electrolyzing compartment 126 but will again become an electrolyzing compartment 126 after the removal mechanism 160 is returned to its original position and the gate 124 is closed (as shown in FIG. 2A for example). For convenience, FIG. 2A, FIG. 2B, FIG. 2C, and FIG. 2D may be collectively referred to herein as FIG. 2.

FIG. 3A is an illustration providing a cut-away side view of an alternative electrolyzer cell 100' similar to that shown in FIG. 1A (as well as FIG. 1B and substantially corresponding to FIG. 2A), representative of the various alternative implementations disclosed herein, shown in an initial ready-to-use configuration for conducting electrolysis. FIG. 3B is an illustration providing a cut-away side view of the alternative electrolyzer cell 100' similar to that shown in FIG. 1A (as well as FIG. 1B and substantially corresponding to FIG. 2B), representative of the various alternative implementations disclosed herein, after being filled with electrolytic materials 150 for electrolysis. FIG. 3C is an illustration providing a cut-away side view of an alternative electrolyzer cell 100' similar to that shown in FIG. 1A (as well as FIG. 1B and substantially corresponding to FIG. 2C), representative of the various alternative implementations disclosed herein, after electrolysis has been performed and liquid components 142 have been drained from the electrolyzing compartment. FIG. 3D is an illustration providing a cut-away side view of an alternative electrolyzer cell 100' similar to that shown in FIG. 1A (as well as FIG. 1B and substantially corresponding to FIG. 2D), representative of the various alternative implementations disclosed herein, after the end product 132 of the electrolysis has been removed from the horizontal cathode 120 surface and from the electrolyzing compartment.

FIG. 3A, FIG. 3B, FIG. 3C, and FIG. 3D—collectively referred to herein as FIG. 3 for convenience—features a gate 124' that may operate on a hinge and swing out of the way, and further features a moveable channeling gutter 162 to facilitate removal of liquid components 142 from the electrolyzing compartment 126 without being deposited onto the conveyor belt 170—possibly having reduced containing sides 174 as shown—said channeling gutter 162 moving into a stored position out of the way of subsequent removal of the end product 132 (as shown in FIG. 3D). The alternative electrolyzer cell 100' of FIG. 3 otherwise operates similar to operations illustrated in FIG. 2 and is representative of the numerous different configurations and alternatives for the various electrolyzer cells disclosed herein.

Figure 4A:
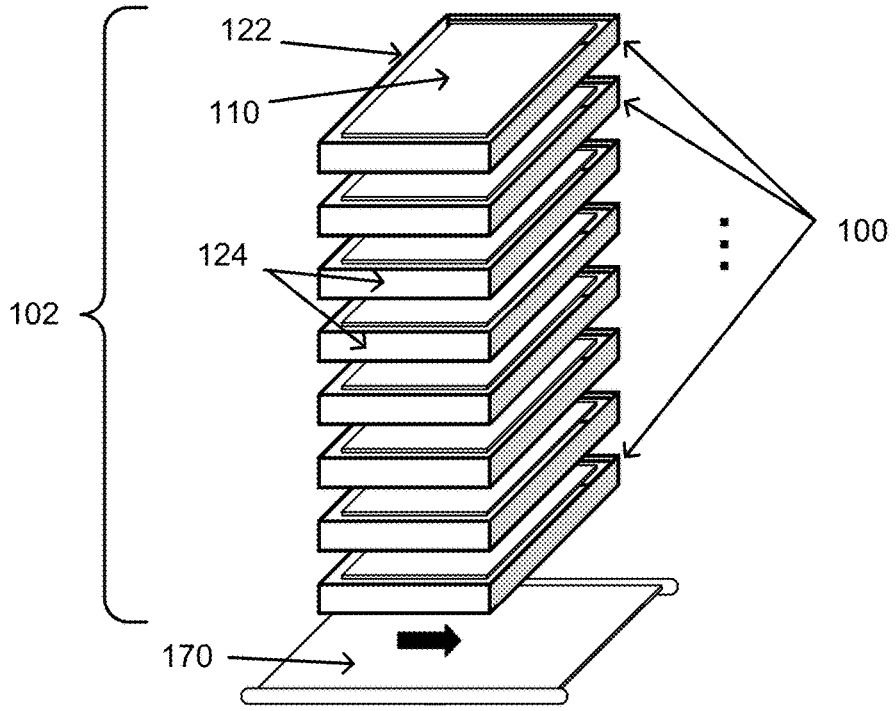
FIG. 4A is an illustration providing a perspective view of a vertical stack of electrolyzer cells representative of various implementations disclosed herein.

FIG. 4A is an illustration providing a perspective view of a vertical stack 102 of electrolyzer cells 100 representative of various implementations disclosed herein. As shown in FIG. 4A, multiple electrolyzer cells 100 may be vertically orientated over a single conveyor belt 170 (further distinguished in the drawing by the block motion arrow) in order to increase overall capacity, minimize floorspace (or footprint), and increase conveyor belt 170 utilization (and minimize conveyor belt 170 buildout).

Figure 4B:
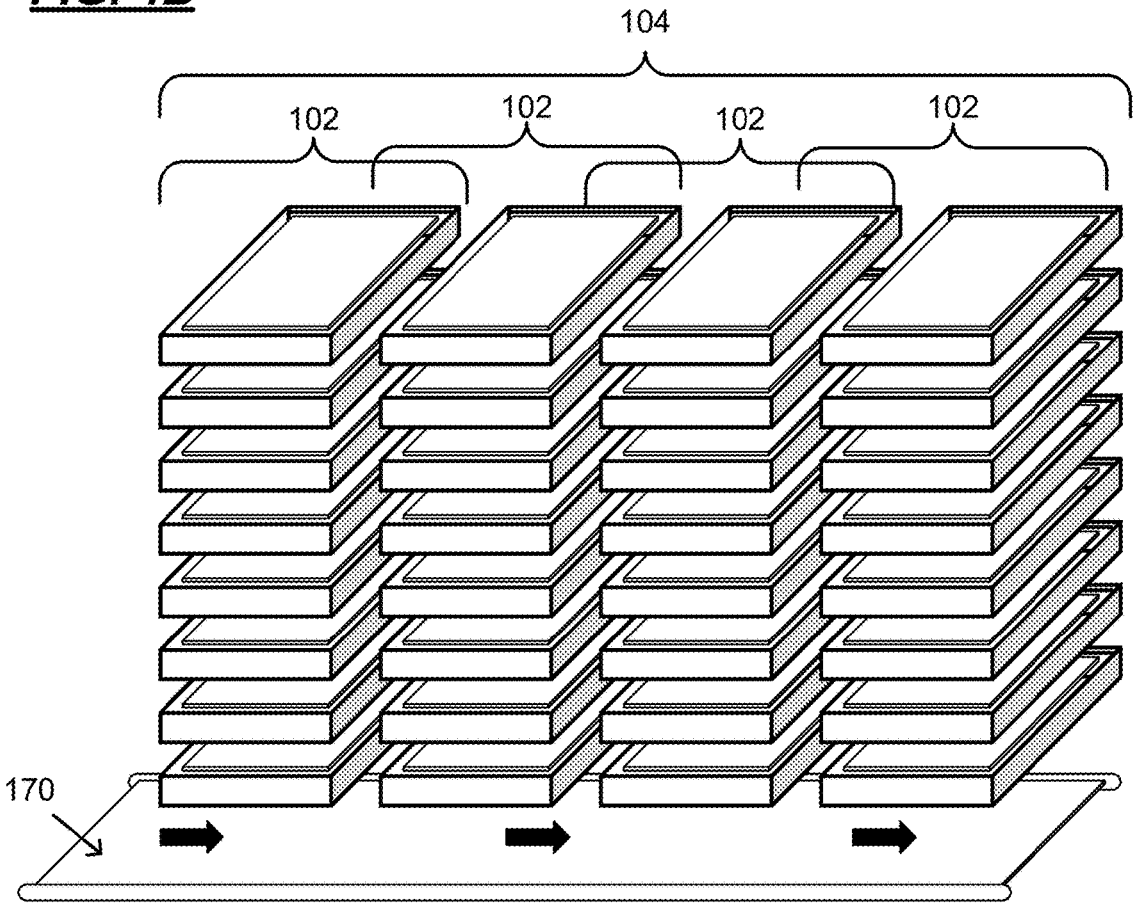
FIG. 4B is an illustration providing a perspective view of a lateral line comprising multiple stacks of electrolyzer cells representative of various implementations disclosed herein.

FIG. 4B is an illustration providing a perspective view of a lateral line 104 comprising multiple vertical stacks 102 of electrolyzer cells 100 representative of various implementations disclosed herein. As shown in FIG. 4B, multiple stacks may be linearly oriented over a single conveyor belt 170 to further increase overall capacity while again increasing conveyor belt 170 utilization (and minimize conveyor belt 170 buildout) versus the need for individual conveyor belts for each stack 102. Furthermore, for certain implementations, multiple stacks 102 may be oriented on both sides of the conveyor belt 170 to form a duplex line (not shown).

Figure 4C:
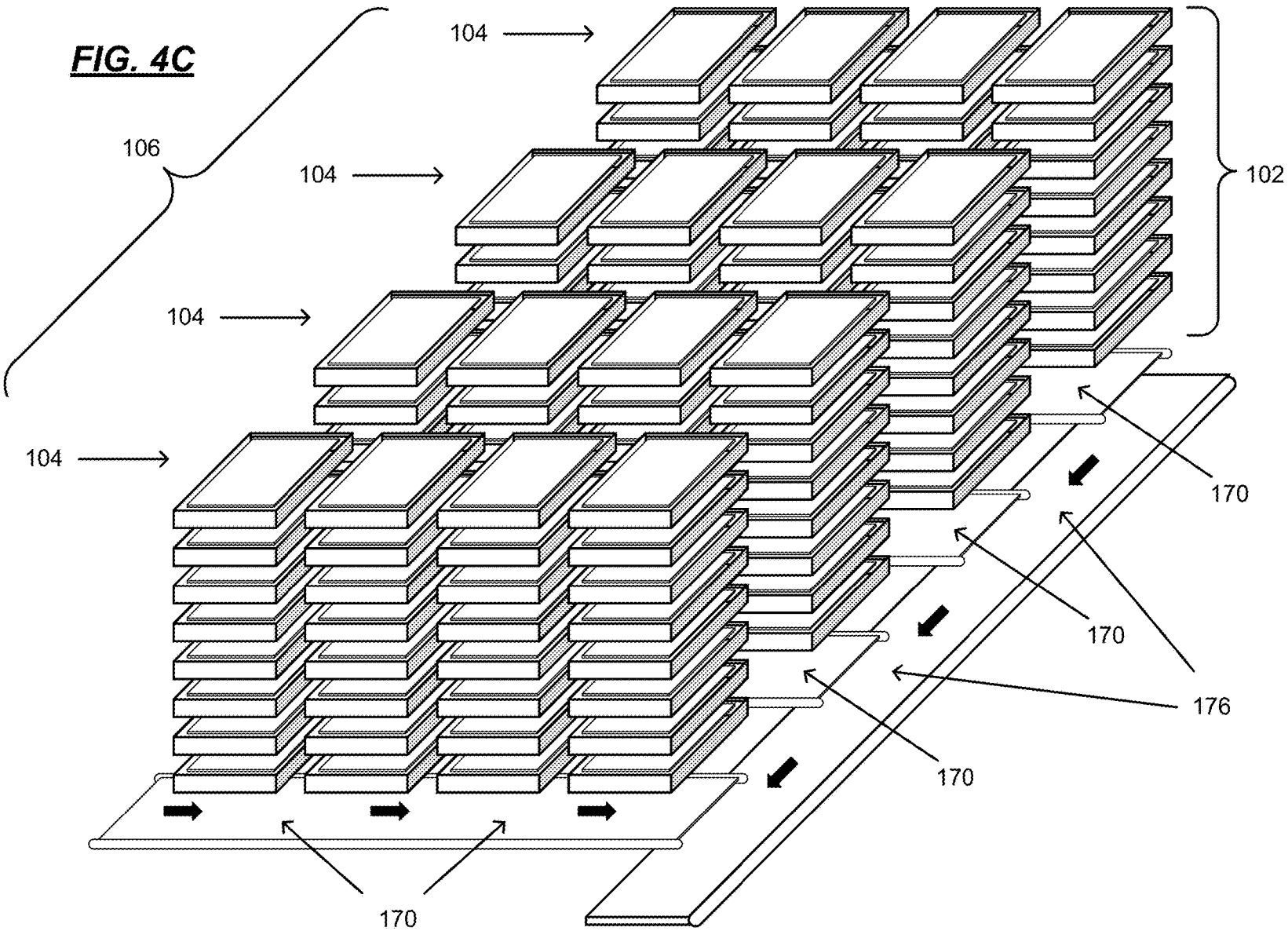
FIG. 4C is an illustration providing a perspective view of a parallel array of multiple lateral lines each comprising multiple stacks of electrolyzer cells representative of various implementations disclosed herein.

FIG. 4C is an illustration providing a perspective view of a parallel array 106 of multiple lateral lines 104 each comprising multiple stacks 102 of electrolyzer cells 100 representative of various implementations disclosed herein. As shown in FIG. 4C, a plurality of lateral lines 104 and their corresponding conveyor belts may be arranged to form a three-dimensional array 106 of electrolyzer cells that feed into a consolidated cross-conveyor belt 176. Furthermore, for certain implementations, the conveyor belts 170 from multiple lines 104 may be oriented on both sides of the cross-conveyor belt 176 to form a duplex array (not shown). Moreover, the specific height, length, and width of such a parallel array 106 can be configured to optimally fit in almost any three-dimensional space although alternative or additional conveyor belt configurations may be needed.

FIG. 5 is a process flow diagram 500 illustrating how the various implementations disclosed herein may be utilized for lead acid battery (LAB) recycling. In FIG. 5, at 502 lead paste might first be desulfurized—such as by treating with sodium hydroxide (NaOH) or potassium hydroxide (KOH) or ammonium hydroxide (NH4OH) or aqueous solution of ammonia—such that the resulting desulfurized lead paste substantially comprises lead components (e.g., Pb, PbO, PbO2, and Pb(OH)2). At 504 this desulfurized lead paste is then combined with an electrolyte and supplemental chemicals to form a slurry mixture (or, in alternative implementations, a slurry solution). At 506 this slurry is then introduced into the electrolyzer cell 100 and, at 508, electrolysis is performed. At 510, the liquid components (which may include residual supplemental chemicals) may then be drained first and, at 512, the solid components resulting from the electrolysis are also removed, although in alternative implementations the liquid components and solid components can be removed from the electrolyzer simultaneously. Regardless, at 514 the solid components end product—which now substantially comprises pure lead (Pb)—is pressed to remove any remaining liquid components and form substantially pure lead bricks which can then be melted to eliminate any residual sodium hydroxide and other minor impurities (such as barium sulfate)—said melting occurring (at temperatures far below those required for smelting—to further purify the lead bricks and form pure lead ingots.

Notably, elements 506-512 of FIG. 5 are performed utilizing the various implementations of an electrolytic cell 100 disclosed herein, although nothing herein limits utilization of such implementations to lead recycling or to just this part of lead recycling, and other utilizations of such implementations is also anticipated by such implementations. For example, various implementations disclosed herein may be used to further process the dross removed during the melting 516. Likewise, with regard to all of the various implementations disclosed herein, alternative implementations are also anticipated wherein the horizontal cathode is instead a horizontal anode and the suspended anode is instead a suspended cathode. Moreover, each step of the processes performed by the various implementations herein disclosed may be performed and controlled by a processing unit or other computing environment to include (but in no way limited to) timing of each step of the operation, coordination between different electrolyzer cells, slurry lines, conveyor belts, etc., and variations in time and charge utilized throughout the electrolysis processes, as well as receiving and reacting to feedback from electrical resistance and other detectable occurrences from the electrolysis while in progress.

Accordingly, various implementations disclosed herein are directed to an electrolyzer comprising a horizontal cathode located below a suspended anode for purposes of performing electrolysis on metal-bearing mixtures or solutions. For several such implementations, the horizontal cathode may comprise the bottom surface of a compartment for containing a mixture or solution of metal components, electrolyte, and/or supplemental chemicals; a horizontal anode for engaging the upper surface of the mixture or solution in the compartment; a gate corresponding to one sidewall of the compartment for facilitating removal of the end-products from the mixture or solution; and/or a removal mechanism for facilitating removal of the end-products of the mixture or solution from the compartment (and the surface of the horizontal cathode) through the gate. Certain implementations disclosed herein are specifically directed to use in recycling of lead acid batteries (LABs) without smelting, although nothing herein is intended to limit the various implementations solely to LAB recycling or lead recovery and, instead, the various implementations disclosed herein may be applied to a variety of different electrolysis operations.

More specifically, disclosed herein are various implementations directed to systems, processes, apparatuses, methods, computer-readable instructions, and other implementations for an electrolyzer comprising: a horizontal cathode having a surface onto which an electrolytic slurry may be emplaced for electrolysis; and an anode suspended above the horizontal cathode for physically engaging the electrolytic slurry for electrolysis. Several such implementations may further comprise vertical containing surfaces for containing the electrolytic slurry onto the horizontal cathode; a gate in the vertical containing surfaces through which an end product resulting from electrolysis can be removed from the cathode; a removing mechanism for removing, from the horizontal cathode, an end product resulting from electrolysis; a direct current electrical supply and a power controller for controlling a current during electrolysis at one or more levels at one or more time periods during electrolysis; and/or a slurry line for emplacing the electrolytic slurry onto the horizontal cathode. For certain such implementations the suspended anode may comprise a horizontal anode surface for physically engaging an upper surface of the electrolyte for electrolysis; the horizontal anode surface may comprise a plurality of vents, trenches, holes, or the like ("breathing holes") through which gaseous compounds ("gasses") resulting from electrolysis can be passed, and/or the horizontal anode surface may be substantially parallel to the horizontal cathode and between 40 mm and 140 mm above the horizontal cathode during electrolysis.

Several alternative implementations disclosed herein may be directed to an apparatus for performing electrolysis comprising: a horizontal cathode having a surface onto which an electrolytic slurry may be emplaced for electrolysis; and an anode suspended above the horizontal cathode, the anode comprising a horizontal surface for physically engaging an upper surface of the electrolytic slurry for electrolysis. Several such implementations may further comprise vertical containing surfaces for containing the electrolytic slurry onto the horizontal cathode; a gate in the vertical containing surfaces through which an end product resulting from electrolysis can be removed from the cathode; a removing mechanism for removing, from the horizontal cathode, an end product resulting from electrolysis; a direct current electrical supply and a power controller for controlling a current during electrolysis at one or more levels at one or more time periods during electrolysis; and/or a slurry line for emplacing the electrolytic slurry onto the horizontal cathode. For certain such implementations the horizontal anode surface comprises a plurality of holes, vents, trenches, or the like ("breathing holes") through which gaseous compounds resulting from electrolysis can be passed; and/or the horizontal anode surface is substantially parallel to the horizontal cathode and between 40 mm and 140 mm above the horizontal cathode during electrolysis.

Other alternative implementations disclosed herein may be directed to a system for performing electrolysis on an electrolytic slurry comprising: a horizontal cathode having a surface onto which the electrolytic slurry may be emplaced for electrolysis; an anode suspended above the horizontal cathode for physically engaging the electrolyte for electrolysis; and a removing mechanism for removing, from the horizontal cathode, an end product resulting from electrolysis. For certain such implementations the suspended anode comprises a horizontal anode surface for physically engaging an upper surface of the electrolytic slurry for electrolysis; and/or the horizontal anode surface comprises a plurality of holes, vents, trenches, or the like through which gaseous compounds resulting from electrolysis can be passed.

Figure 6:
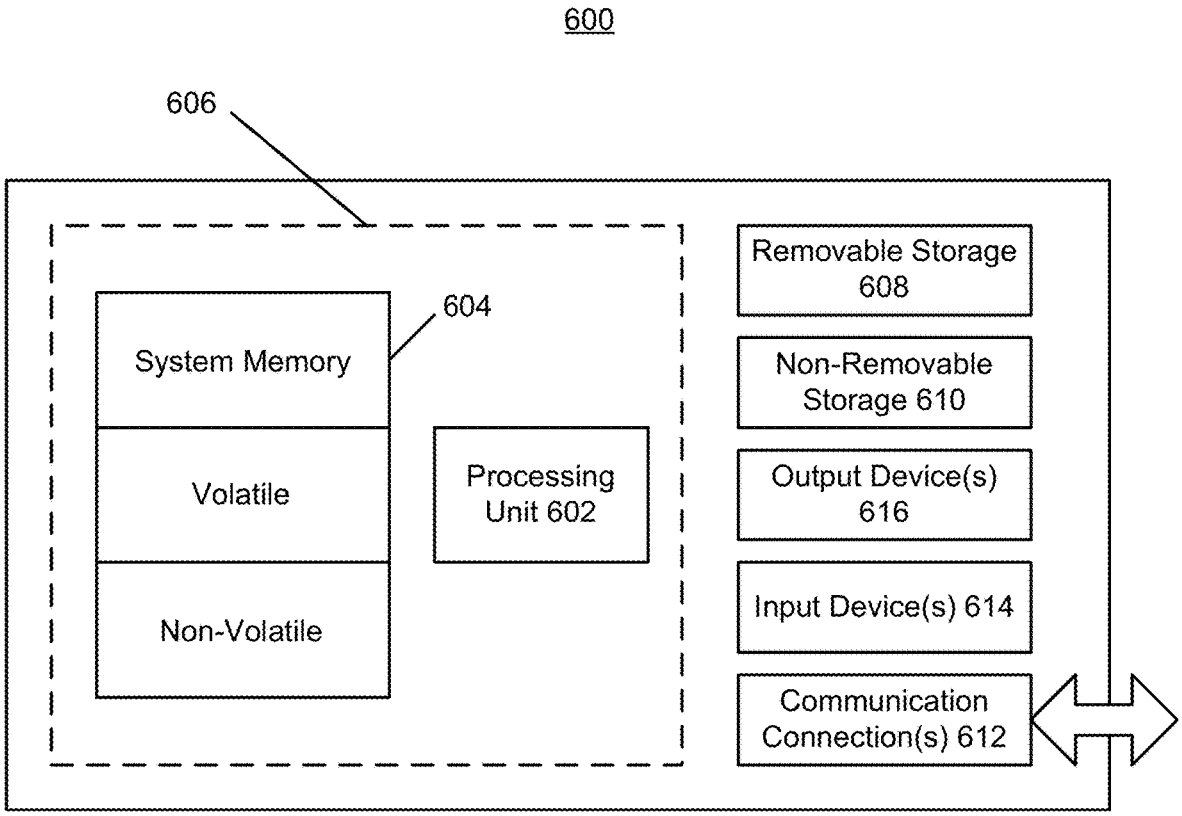
FIG. 6 is a block diagram of an example computing environment that may be used in conjunction with any of the various implementations and aspects herein disclosed.

FIG. 6 is a block diagram of an example computing environment that may be used in conjunction with example implementations and aspects such as those disclosed and described with regard to the other figures presented herein and herewith. The computing system environment is only one example of a suitable computing environment and is not intended to suggest any limitation as to the scope of use or functionality.

Numerous other general purpose or special purpose computing system environments or configurations may be used. Examples of well-known computing systems, environments, and/or configurations that may be suitable for use include, but are not limited to, personal computers (PCs), server computers, handheld or laptop devices, multiprocessor systems, microprocessor-based systems, network PCs, minicomputers, mainframe computers, embedded systems, distributed computing environments that include any of the above systems or devices, and the like.

Computer-executable instructions, such as program modules, being executed by a computer may be used. Generally, program modules include routines, programs, objects, components, data structures, and so forth that perform particular tasks or implement particular abstract data types. Distributed computing environments may be used where tasks are performed by remote processing devices that are linked through a communications network or other data transmission medium. In a distributed computing environment, program modules and other data may be located in both local and remote computer storage media including memory storage devices.

The various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA), an analog-to-digital converter (ADC), or other programmable logic device, discrete gate or transistor logic, discrete hardware components, discrete data acquisition components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more modules operable to perform one or more of the steps and/or actions described above.

With reference to FIG. 6, an exemplary system for implementing aspects described herein includes a computing device, such as computing device 600. In a basic configuration, computing device 600 typically includes at least one processing unit 602 and memory 604. Depending on the exact configuration and type of computing device, memory 604 may be volatile (such as random access memory (RAM)), non-volatile (such as read-only memory (ROM), flash memory, etc.), or some combination of the two. This basic configuration is illustrated in FIG. 6 by dashed line 606 as may be referred to collectively as the "compute" component.

Computing device 600 may have additional features/functionality. For example, computing device 600 may include additional storage (removable and/or non-removable) including, but not limited to, magnetic or optical disks or tape. Such additional storage is illustrated in FIG. 6 by removable storage 608 and non-removable storage 610. Computing device 600 typically includes a variety of computer readable media. Computer readable media can be any available media that can be accessed by device 600 and may include both volatile and non-volatile media, as well as both removable and non-removable media.

Computer storage media include volatile and non-volatile media, as well as removable and non-removable media, implemented in any method or technology for storage of information such as computer readable instructions, data structures, program modules or other data. Memory 604, removable storage 608, and non-removable storage 610 are all examples of computer storage media. Computer storage media include, but are not limited to, RAM, ROM, electrically erasable program read-only memory (EEPROM), flash memory or other memory technology, CD-ROM, digital versatile disks (DVD), or other optical storage, magnetic cassettes, magnetic tape, magnetic disk storage or other magnetic storage devices, or any other medium which can be used to store the information and which can be accessed by computing device 600. Any such computer storage media may be part of computing device 600.

Computing device 600 may contain communication connection(s) 612 that allow the device to communicate with other devices. Computing device 600 may also have input device(s) 614 such as a keyboard, mouse, pen, voice input device, touch input device, and so forth. Output device(s) 616 such as a display, speakers, printer, and so forth may also be included. All these devices are well-known in the art and need not be discussed at length herein. Computing device 600 may be one of a plurality of computing devices 600 inter-connected by a network. As may be appreciated, the network may be any appropriate network, each computing device 600 may be connected thereto by way of communication connection(s) 612 in any appropriate manner, and each computing device 600 may communicate with one or more of the other computing devices 600 in the network in any appropriate manner. For example, the network may be a wired or wireless network within an organization or home or the like, and may include a direct or indirect coupling to an external network such as the Internet or the like. Moreover, PCI, PCIe, and other bus protocols might be utilized for embedding the various implementations described herein into other computing systems.

Interpretation of Disclosures Herein

It should be understood that the various techniques described herein may be implemented in connection with hardware or software or, where appropriate, with a combination of both. Thus, the processes and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium where, when the program code is loaded into and executed by a machine, such as a computer, the machine becomes an apparatus for practicing the presently disclosed subject matter.

In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an API, reusable controls, or the like. Such programs may be implemented in a high-level procedural or object-oriented programming language to communicate with a computer system. However, the program(s) can be implemented in assembly or machine language. In any case, the language may be a compiled or interpreted language and it may be combined with hardware implementations.

Although exemplary implementations may refer to utilizing aspects of the presently disclosed subject matter in the context of one or more stand-alone computer systems, the subject matter is not so limited, but rather may be implemented in connection with any computing environment, such as a network or distributed computing environment. Still further, aspects of the presently disclosed subject matter may be implemented in or across a plurality of processing chips or devices, and storage may similarly be affected across a plurality of devices. Such devices might include PCs, network servers, and handheld devices, for example.

Certain implementations described herein may utilize a cloud operating environment that supports delivering computing, processing, storage, data management, applications, and other functionality as an abstract service rather than as a standalone product of computer hardware, software, etc. Services may be provided by virtual servers that may be implemented as one or more processes on one or more computing devices. In some implementations, processes may migrate between servers without disrupting the cloud service. In the cloud, shared resources (e.g., computing, storage) may be provided to computers including servers, clients, and mobile devices over a network. Different networks (e.g., Ethernet, Wi-Fi, 802.x, cellular) may be used to access cloud services. Users interacting with the cloud may not need to know the particulars (e.g., location, name, server, database, etc.) of a device that is actually providing the service (e.g., computing, storage). Users may access cloud services via, for example, a web browser, a thin client, a mobile application, or in other ways. To the extent any physical components of hardware and software are herein described, equivalent functionality provided via a cloud operating environment is also anticipated and disclosed.

Additionally, a controller service may reside in the cloud and may rely on a server or service to perform processing and may rely on a data store or database to store data. While a single server, a single service, a single data store, and a single database may be utilized, multiple instances of servers, services, data stores, and databases may instead reside in the cloud and may, therefore, be used by the controller service. Likewise, various devices may access the controller service in the cloud, and such devices may include (but are not limited to) a computer, a tablet, a laptop computer, a desktop monitor, a television, a personal digital assistant, and a mobile device (e.g., cellular phone, satellite phone, etc.). It is possible that different users at different locations using different devices may access the controller service through different networks or interfaces. In one example, the controller service may be accessed by a mobile device. In another example, portions of controller service may reside on a mobile device. Regardless, controller service may perform actions including, for example, presenting content on a secondary display, presenting an application (e.g., browser) on a secondary display, presenting a cursor on a secondary display, presenting controls on a secondary display, and/or generating a control event in response to an interaction on the mobile device or other service. In specific implementations, the controller service may perform portions of methods described herein.

Anticipated Alternatives

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Moreover, it will be apparent to one skilled in the art that other implementations may be practiced apart from the specific details disclosed above.

The drawings described above and the written description of specific structures and functions below are not presented to limit the scope of what has been invented or the scope of the appended claims. Rather, the drawings and written description are provided to teach any person skilled in the art to make and use the inventions for which patent protection is sought. Those skilled in the art will appreciate that not all features of a commercial implementation of the inventions are described or shown for the sake of clarity and understanding. Skilled artisans will further appreciate that block diagrams herein can represent conceptual views of illustrative circuitry embodying the principles of the technology, and that any flow charts, state transition diagrams, pseudocode, and the like represent various processes which may be embodied in computer readable medium and so executed by a computer or processor, whether or not such computer or processor is explicitly shown. The functions of the various elements including functional blocks may be provided through the use of dedicated electronic hardware as well as electronic circuitry capable of executing computer program instructions in association with appropriate software. Persons of skill in this art will also appreciate that the development of an actual commercial implementation incorporating aspects of the inventions will require numerous implementation-specific decisions to achieve the developer's ultimate goal for the commercial implementation. Such implementation-specific decisions may include, and likely are not limited to, compliance with system-related, business-related, government-related, and other constraints, which may vary by specific implementation, location, and from time to time. While a developer's efforts might be complex and time-consuming in an absolute sense, such efforts would be, nevertheless, a routine undertaking for those of skill in this art having benefit of this disclosure.

It should be understood that the implementations disclosed and taught herein are susceptible to numerous and various modifications and alternative forms. Thus, the use of a singular term, such as, but not limited to, "a" and the like, is not intended as limiting of the number of items. Also, the use of relational terms, such as, but not limited to, "top," "bottom," "left," "right," "upper," "lower," "down," "up," "side," and the like, are used in the written description for clarity in specific reference to the drawings and are not intended to limit the scope of the invention or the appended claims. For particular implementations described with reference to block diagrams and/or operational illustrations of methods, it should be understood that each block of the block diagrams and/or operational illustrations, and combinations of blocks in the block diagrams and/or operational illustrations, may be implemented by analog and/or digital hardware, and/or computer program instructions. Computer program instructions for use with or by the implementations disclosed herein may be written in an object-oriented programming language, conventional procedural programming language, or lower-level code, such as assembly language and/or microcode. The program may be executed entirely on a single processor and/or across multiple processors, as a stand-alone software package or as part of another software package. Such computer program instructions may be provided to a processor of a general-purpose computer, special-purpose computer, ASIC, and/or other programmable data processing system. The executed instructions may also create structures and functions for implementing the actions specified in the mentioned block diagrams and/or operational illustrations. In some alternate implementations, the functions/actions/structures noted in the drawings may occur out of the order noted in the block diagrams and/or operational illustrations. For example, two operations shown as occurring in succession, in fact, may be executed substantially concurrently or the operations may be executed in the reverse order, depending on the functionality/acts/structure involved.

The term "computer-readable instructions" as used above refers to any instructions that may be performed by the processor and/or other components. Similarly, the term "computer-readable medium" refers to any storage medium that may be used to store the computer-readable instructions. Such a medium may take many forms, including, but not limited to, non-volatile media, volatile media, and transmission media. Non-volatile media may include, for example, optical or magnetic disks, such as the storage device. Volatile media may include dynamic memory, such as main memory. Transmission media may include coaxial cables, copper wire, and fiber optics, including wires of the bus. Transmission media may also take the form of acoustic or light waves, such as those generated during radio frequency (RF) and infrared (IR) data communications. Common forms of computer-readable media may include, for example, a floppy disk, a flexible disk, hard disk, magnetic tape, any other magnetic medium, a CD ROM, DVD, any other optical medium, punch cards, paper tape, any other physical medium with patterns of holes, a RAM, a PROM, an EPROM, a FLASH EPROM, any other memory chip or cartridge, a carrier wave, or any other medium from which a computer can read.

In the foregoing description, for purposes of explanation and non-limitation, specific details are set forth—such as particular nodes, functional entities, techniques, protocols, standards, etc.—in order to provide an understanding of the described technology. In other instances, detailed descriptions of well-known methods, devices, techniques, etc. are omitted so as not to obscure the description with unnecessary detail. All statements reciting principles, aspects, embodiments, and implementations, as well as specific examples, are intended to encompass both structural and functional equivalents, and such equivalents include both currently known equivalents as well as equivalents developed in the future, i.e., any elements developed that perform the same function, regardless of structure. While the disclosed implementations have been described with reference to one or more particular implementations, those skilled in the art will recognize that many changes may be made thereto. Therefore, each of the foregoing implementations and obvious variations thereof is contemplated as falling within the spirit and scope of the disclosed implementations, which are set forth in the claims presented below.

Copyright Notice

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

What is claimed:

1. An electrolyzer comprising:

a solid non-melting horizontal cathode having a surface onto which an electrolytic slurry may be emplaced for electrolysis;

vertical containing surfaces for containing the electrolytic slurry onto the horizontal cathode;

a gate in the vertical containing surfaces through which an end product resulting from electrolysis can be removed from the cathode; and an anode suspended above the horizontal cathode for physically engaging the electrolytic slurry for electrolysis.

2. The electrolyzer of claim 1, wherein the vertical containing surfaces for containing the electrolytic slurry onto the horizontal cathode are comprised of a non-conductive material.

3. The electrolyzer of claim 1, wherein the internal surfaces of the vertical containing surfaces for containing the electrolytic slurry onto the horizontal cathode are comprised of a non-conductive material.

4. The electrolyzer of claim 1, further comprising a removing mechanism for removing, from the horizontal cathode, the end product resulting from electrolysis.

5. The electrolyzer of claim 4, wherein the suspended anode comprises a horizontal anode surface for physically engaging an upper surface of the electrolytic slurry for electrolysis.

6. The electrolyzer of claim 5, wherein the horizontal anode surface comprises a plurality of vents through which gaseous compounds resulting from electrolysis can be passed.

7. The electrolyzer of claim 6, further comprising a direct current electrical supply and a power controller for controlling a current during electrolysis at one or more levels at one or more time periods during electrolysis.

8. The electrolyzer of claim 7, wherein the horizontal anode surface is substantially parallel to the horizontal cathode and between 40 mm and 140 mm above the horizontal cathode during electrolysis.

9. The electrolyzer of claim 1, further comprising a slurry line for emplacing the electrolytic slurry onto the horizontal cathode.

10. An apparatus for performing electrolysis comprising:

a solid non-melting horizontal cathode having a surface onto which an electrolytic slurry may be emplaced for electrolysis;

vertical containing surfaces for containing the electrolytic slurry onto the horizontal cathode;

a gate in the vertical containing surfaces through which an end product resulting from electrolysis can be removed from the cathode; and an anode suspended above the horizontal cathode, the anode comprising a horizontal surface for physically engaging an upper surface of the electrolytic slurry for electrolysis.

11. The apparatus of claim 10, wherein the vertical containing surfaces for containing the electrolytic slurry onto the horizontal cathode are comprised of a non-conductive material.

12. The apparatus of claim 10, wherein the internal surfaces of the vertical containing surfaces for containing the electrolytic slurry onto the horizontal cathode are comprised of a non-conductive material.

13. The apparatus of claim 10, further comprising a removing mechanism for removing, from the horizontal cathode, the end product resulting from electrolysis.

14. The apparatus of claim 10, wherein the horizontal anode surface comprises a plurality of vents through which gaseous compounds resulting from electrolysis can be passed.

15. The apparatus of claim 10, wherein the horizontal anode surface is substantially parallel to the horizontal cathode and between 40 mm and 140 mm above the horizontal cathode during electrolysis.

16. The apparatus of claim 10, further comprising a direct current electrical supply and a power controller for controlling a current during electrolysis at one or more levels at one or more time periods during electrolysis.

17. The apparatus of claim 10, further comprising a slurry line for emplacing the electrolytic slurry onto the horizontal cathode.

18. A system for performing electrolysis on an electrolytic slurry comprising:

a solid non-melting horizontal cathode having a surface onto which the electrolytic slurry may be emplaced for electrolysis;

an anode suspended above the horizontal cathode for physically engaging the electrolytic slurry for electrolysis;

vertical containing surfaces for containing the electrolytic slurry onto the horizontal cathode;

a gate in the vertical containing surfaces through which an end product resulting from electrolysis can be removed from the cathode; and a removing mechanism for removing, from the horizontal cathode, an end product resulting from electrolysis.

19. The electrolyzer of claim 18, wherein the suspended anode comprises a horizontal anode surface for physically engaging an upper surface of the electrolytic slurry for electrolysis.

20. The electrolyzer of claim 19, wherein the horizontal anode surface comprises a plurality of vents through which gaseous compounds resulting from electrolysis can be passed.

* * * * *